US011492570B2

(12) United States Patent
Zhang et al.

(10) Patent No.: US 11,492,570 B2
(45) **Date of Patent: *Nov. 8, 2022**

(54) METHOD OF USE OF COMPOSITION COMPRISING A QUATERNARY AMMONIUM COMPOUND, A CATIONIC POLYSACCHARIDE AND A NONIONIC POLYSACCHARIDE

(71) Applicant: RHODIA OPERATIONS, Paris (FR)

(72) Inventors: Hai Zhou Zhang, Singapore (SG); Nikolay Christov, Singapore (SG); Da Wei Jin, Singapore (SG)

(73) Assignee: RHODIA OPERATIONS, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/318,874

(22) PCT Filed: Jan. 15, 2015

(86) PCT No.: PCT/EP2015/050701

§ 371 (c)(1),
(2) Date: Dec. 14, 2016

(87) PCT Pub. No.: WO2015/192974

PCT Pub. Date: Dec. 23, 2015

(65) Prior Publication Data

US 2017/0130165 A1 May 11, 2017

(30) Foreign Application Priority Data

Jun. 18, 2014 (EP) ..... 14173005

(51) Int. Cl.

| | |
|---|---|
| ***C11D 3/37*** | (2006.01) |
| ***C11D 3/00*** | (2006.01) |
| ***C11D 3/22*** | (2006.01) |
| ***C11D 1/62*** | (2006.01) |
| ***C11D 3/50*** | (2006.01) |
| ***C11D 11/00*** | (2006.01) |
| ***C11D 1/835*** | (2006.01) |
| ***B65D 1/02*** | (2006.01) |
| ***B65D 41/04*** | (2006.01) |
| ***B65D 25/40*** | (2006.01) |
| ***C11D 3/30*** | (2006.01) |
| ***C11D 1/66*** | (2006.01) |

(52) U.S. Cl.

CPC ..... *C11D 3/001* (2013.01); *B65D 1/02* (2013.01); *B65D 25/40* (2013.01); *B65D 41/04* (2013.01); *C11D 1/62* (2013.01); *C11D 1/66* (2013.01); *C11D 1/835* (2013.01); *C11D 3/0015* (2013.01); *C11D 3/222* (2013.01); *C11D 3/227* (2013.01); *C11D 3/30* (2013.01); *C11D 3/50* (2013.01); *C11D 11/0017* (2013.01); *C11D 11/0094* (2013.01)

(58) Field of Classification Search

CPC ..... C11D 3/001; C11D 3/3742; C11D 3/227; C11D 3/373; C11D 3/3773; C11D 1/62; C11D 3/3765; C11D 3/0015; C11D 3/18; C11D 3/222; C11D 3/3738; C11D 1/008; C11D 11/0017; C11D 3/3951; C11D 3/40; C11D 3/50; C11D 17/0026; C11D 1/02; C11D 3/3723; C11D 3/3746; C11D 17/0013; C11D 17/042; C11D 1/345; C11D 1/65; C11D 3/30; C11D 3/37; C11D 3/3707; C11D 3/3749; C11D 3/3796; C11D 17/0017; C11D 17/043; C11D 1/002; C11D 1/146; C11D 1/29; C11D 1/38; C11D 1/66; C11D 1/662; C11D 1/83; C11D 1/835; C11D 1/88; C11D 1/94; C11D 3/166; C11D 3/2003; C11D 3/2006; C11D 3/2068; C11D 3/2093; C11D 3/226; C11D 3/3719; C11D 3/3726; C11D 3/3769; C11D 3/3776; C11D 3/386; C11D 3/38663

See application file for complete search history.

(56) References Cited

U.S. PATENT DOCUMENTS

| | | | | |
|---|---|---|---|---|
| 10,227,548 | B2 * | 3/2019 | Zhang | C11D 3/227 |
| 10,351,805 | B2 * | 7/2019 | Zhang | C11D 3/227 |
| 2003/0216280 | A1 * | 11/2003 | Martens | C11D 1/62 510/466 |
| 2014/0206587 | A1 * | 7/2014 | Chen | A61K 8/66 510/119 |

FOREIGN PATENT DOCUMENTS

| | | | |
|---|---|---|---|
| CA | 2444206 | A1 | 4/2004 |
| CN | 1292024 | A | 4/2001 |
| CN | 202609228 | U | 12/2012 |
| EP | 0002085 | A2 | 5/1979 |
| EP | 1062312 | * | 4/2005 |
| WO | 2007134666 | A1 | 11/2007 |

OTHER PUBLICATIONS

Machine Translation of CN1292024A.
Machine Translation of CN202609228U.

* cited by examiner

*Primary Examiner* — John R Hardee
(74) *Attorney, Agent, or Firm* — Vorys, Sater, Seymour and Pease LLP

(57) ABSTRACT

The present invention relates to a method for enhancing fragrance or perfume longevity of a composition by adding to the composition (a) a quaternary ammonium compound; (b) a cationic polysaccharide; (c) a nonionic polysaccharide; and (d) a fragrance material or perfume. In particular, the quaternary ammonium compound is a biodegradable quaternary ammonium compound. The composition has improved perfume longevity.

10 Claims, No Drawings

METHOD OF USE OF COMPOSITION COMPRISING A QUATERNARY AMMONIUM COMPOUND, A CATIONIC POLYSACCHARIDE AND A NONIONIC POLYSACCHARIDE

This application claims priority to European application No. 14173005.1 filed on Jun. 18, 2014, the whole content of this application being incorporated herein by reference for all purposes.

TECHNICAL FIELD

The present invention relates to a method of use of a composition, in particular, a fabric conditioning composition, comprising at least a quaternary ammonium compound, a cationic polysaccharide, a nonionic polysaccharide and a fragrance material or perfume. In particular, the quaternary ammonium compound is a biodegradable quaternary ammonium compound.

BACKGROUND ART

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

Fabric conditioning compositions can be added in the rinse cycle of the laundering process to soften fabrics and to impart them nice smell. Conventionally, fabric conditioning systems are based on quaternary ammonium compounds, also named as quats, notably cetrimonium chloride, behentrimonium chloride, N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2-hydroxyethyl)N-methyl ammonium methylsulfate or 1,2-di(stearoyl-oxy)-3-trimethyl ammoniumpropane chloride.

However, quats are known difficult to be bio-degraded and thus exhibit eco toxicity. There is a general trend in the industry to switch to other conditioning systems. One option is to use ester quats which provide better biodegradability and lower eco toxicity. Nevertheless, one problem associated with the ester quats is that the stability of such compounds is not satisfactory, particularly when the ester quats are present at high levels in the fabric conditioning composition, which may be attributed to its biodegradable nature. Thus, there is a need to provide a composition which provides good stability and excellent softening performance.

On the other hand, fragrance materials or perfumes are often incorporated into the fabric conditioning compositions to provide a pleasant odour to fabrics laundered. One problem is that once adsorbed onto the targeted surface, for example the fabrics, the fragrance materials or the perfumes tend to be dissipated very quickly. Thus, there is also a need to provide a composition in which the fragrance materials or the perfumes incorporated can have long-lasting odour and the odour can be slowly emitted from the substrate (such as the fabric). This property is often described as substantivity, tenacity or longevity of the fragrance material or the perfume.

The art teaches that addition of cationic polymers to fabric conditioning compositions has a variety of benefits. U.S. Pat. No. 6,492,322, Megan et al., discloses fabric softening compositions comprising biodegradable diester softening compounds and cationic polymers including polysaccharides, such as gums, starches and certain cationic synthetic polymers.

There is a need to provide a composition having excellent softening performance, and improved perfume longevity as well.

SUMMARY OF INVENTION

It has now been found that the above objectives can be met by providing a composition according to the present invention.

In a first aspect of the present invention, there is provided a method for enhancing fragrance or perfume longevity of a composition by adding to the composition (a) a quaternary ammonium compound; (b) a cationic polysaccharide; (c) a nonionic polysaccharide; and (d) a fragrance material or perfume.

In one embodiment, the cationic polysaccharide is a cationic guar.

In another embodiment, the cationic polysaccharide is a cationic guar and the nonionic polysaccharide is a nonionic guar.

In still another embodiment, the cationic polysaccharide has an average molecular weight of between 100,000 daltons and 1,500,000 daltons.

In still another embodiment, the quaternary ammonium compound has the general formula (I):

$$[N^+(R_1)(R_2)(R_3)(R_4)]_yX^- \quad (I)$$

wherein: $R_1$, $R_2$, $R_3$ and $R_4$, which may be the same or different, is a $C_1$-$C_{30}$ hydrocarbon group, optionally containing a heteroatom or an ester or amide group;

X is an anion;

y is the valence of X.

In still another embodiment, the quaternary ammonium compound has the general formula (II):

$$[N^+(R_5)_2(R_6)(R_7)]_yX^- \quad (II)$$

wherein:

$R_5$ is an aliphatic $C_{16-22}$ group;

$R_6$ is a $C_1$-$C_3$ alkyl group;

$R_7$ is $R_5$ or $R_6$;

X is an anion;

y is the valence of X.

In still another embodiment, the quaternary ammonium compound has the general formula (III):

$$[N^+((CH_2)_n\text{-}T\text{-}R_8)_2(R_8)(R_9)]_yX^- \quad (III)$$

wherein:

$R_9$ group is independently selected from $C_1$-$C_4$ alkyl or hydroxylalkyl group;

$R_8$ group is independently selected from $C_1$-$C_{30}$ alkyl or alkenyl group;

T is —C(═O)—O—;

n is an integer from 0 to 5;

X is an anion;

y is the valence of X.

In still another embodiment, the quaternary ammonium compound has the general formula (IV):

$$[N^+(C_2H_4\text{—}OOCR_{10})_2(CH_3)(C_2H_4\text{—}OH)](CH_3)_zSO_4^- \quad (IV)$$

wherein $R_{10}$ is a $C_{12}$-$C_{20}$ alkyl group;

z is an integer from 1 to 3.

In still another embodiment, the quaternary ammonium compound is chosen from the group consisting of:

TET: Di(tallowcarboxyethyl)hydroxyethyl methyl ammonium methylsulfate;

TEO: Di(oleocarboxyethyl)hydroxyethyl methyl ammonium methylsulfate;

TES: Distearyl hydroxyethyl methyl ammonium methylsulfate;

TEHT: Di(hydrogenated tallow-carboxyethyl)hydroxyethyl methyl ammonium methylsulfate;

TEP: Di(palmiticcarboxyethyl)hydroxyethyl methyl ammonium methylsulfate;

DEEDMAC: Dimethylbis[2-[(1-oxooctadecyl)oxy]ethyl] ammonium chloride; and

DHT: Dihydrogenated tallowdimethylammonium chloride.

In still another embodiment, the composition comprises from 0.01 to 10 wt % of the fragrance material or perfume based on the total weight of the composition.

In still another embodiment, the composition comprises from 0.1 to 5 wt % of the fragrance material or perfume based on the total weight of the composition.

In still another embodiment, the ratio of the weight of the quaternary ammonium compound in the composition and the total weight of the cationic polysaccharide and the nonionic polysaccharide in the composition is between 100:1 and 2:1.

In still another embodiment, the ratio of the weight of the quaternary ammonium compound in the composition and the total weight of the cationic polysaccharide and the nonionic polysaccharide in the composition is between 30:1 and 5:1.

In still another embodiment, the composition further comprises an inorganic salt.

In still another embodiment, the composition is a fabric conditioning composition.

Other advantages and more specific properties of the method and the composition according to the present invention will be clear after reading the following description of the invention.

DETAILED DESCRIPTION

In one aspect of the present invention, there is provided a method for enhancing fragrance or perfume longevity of a composition by adding to the composition (a) a quaternary ammonium compound; (b) a cationic polysaccharide; (c) a nonionic polysaccharide; and (d) a fragrance material or perfume.

It has been found that the above mentioned composition containing the fragrance material or perfume exhibits improved fragrance/perfume performance compared to conventional compositions. Without wishing to be bound by theory, it is believed that those beneficial effects may be attributed to the synergistic effect of the cationic polysaccharide, the nonionic polysaccharide and the quaternary ammonium compound, which enhances the deposition of the fragrance material or perfume on a substrate, in particular, on a fabric, extending gradually the release of the fragrance material or perfume, enhancing the fragrance or perfume longevity (substantivity). As a result, the odour of the fragrance material or perfume can remain substantive for an extended time period on the substrate, in particular, the fabric, after the rinsing and drying (line or machine drying) steps.

It has also been found that, in accordance to the present invention, some proportion of the quaternary ammonium compound in the composition could be reduced, by substitution with the cationic polysaccharide and the nonionic polysaccharide without any negative effect on softening performance of the composition. While not wishing to be bound by theory, it is believed that the combination of the quaternary ammonium compound, the cationic polysaccharide and the nonionic polysaccharide could provide synergistic effect in enhancing the softening performance.

Throughout the description, including the claims, the term "comprising one" or "comprising a" should be understood as being synonymous with the term "comprising at least one", unless otherwise specified, and "between" should be understood as being inclusive of the limits.

In the context of this invention, "textile care agent" is understood to mean both washing and cleaning agents and pretreatment agents, as well as agents for conditioning textile fabrics such as delicate fabric washing agents, and post-treatment agents such as conditioners.

In the context of this invention, the term "fabric conditioning" is used herein the broadest sense to include any conditioning benefit(s) to textile fabrics, materials, yarns, and woven fabrics. One such conditioning benefit is softening fabrics. Other non-limiting conditioning benefits include fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency; refreshing, anti-microbial, odor resistance; perfume freshness, perfume longevity, and mixtures thereof.

"Alkyl" as used herein means a straight chain or branched saturated aliphatic hydrocarbon group. "Alkenyl", as used herein, refers to an aliphatic group containing at least one double bond and is intended to include both "unsubstituted alkenyls" and "substituted alkenyls", the latter of which refers to alkenyl moieties having substituents replacing a hydrogen on one or more carbon atoms of the alkenyl group.

The term "cationic polymer" as used herein means any polymer which has a cationic charge.

The term "quaternary ammonium compound" as used herein means a compound containing at least one quaternized nitrogen wherein the nitrogen atom is attached to four organic groups. The quaternary ammonium compound may comprise one or more quaternized nitrogen atoms.

The term "cationic polysaccharide" as used herein means a polysaccharide or a derivative thereof that has been chemically modified to provide the polysaccharide or the derivative thereof with a net positive charge in a pH neutral aqueous medium. The cationic polysaccharide may also include those that are non permanently charged, e.g. a derivative that can be cationic below a given pH and neutral above that pH. Non-modified polysaccharides, such as starch, cellulose, pectin, carageenan, guars, xanthans, dextrans, curdlans, chitosan, chitin, and the like, can be chemically modified to impart cationic charges thereon. A common chemical modification incorporates quaternary ammonium substituents to the polysaccharide backbones. Other suitable cationic substituents include primary, secondary or tertiary amino groups or quaternary sulfonium or phosphinium groups. Additional chemical modifications may include cross-linking, stabilization reactions (such as alkylation and esterification), phophorylations, hydrolyzations.

The term "nonionic polysaccharide" as used herein refers to a polysaccharide or a derivative thereof that has been chemically modified to provide the polysaccharide or the derivative thereof with a net neutral charge in a pH neutral aqueous medium; or a non-modified polysaccharide.

Preferably, the quaternary ammonium compound is not a silicone containing quaternary ammonium compound, that is to say, the quaternary ammonium compound does not contain any siloxane bonds (—Si—O—Si—) or silicon-carbon bonds.

In one embodiment, the quaternary ammonium compound is water dispersible.

In one embodiment, the quaternary ammonium compound of the present invention is a compound of the general formula (I):

$$[N^+(R_1)(R_2)(R_3)(R_4)]_yX^- \quad (I)$$

wherein:

$R_1$, $R_2$, $R_3$ and $R_4$, which may be the same or different, is a $C_1$-$C_{30}$ hydrocarbon group, typically an alkyl, hydroxyalkyl or ethoxylated alkyl group, optionally containing a heteroatom or an ester or amide group;

X is an anion, for example halide, such as Cl or Br, sulphate, alkyl sulphate, nitrate or acetate;

y is the valence of X.

In one embodiment, the quaternary ammonium compound is an alkyl quat, such as a dialkyl quat, or an ester quat such as a dialkyl diester quat.

The dialkyl quat may be a compound of general formula (II):

$$[N^+(R_5)_2(R_6)(R_7)]_yX^- \quad (II)$$

wherein:

$R_5$ is an aliphatic $C_{16-22}$ group;

$R_6$ is a $C_1$-$C_3$ alkyl group;

$R_7$ is $R_5$ or $R_6$;

X is an anion, for example, halide such as Cl or Br, sulphate, alkyl sulphate, nitrate or acetate;

y is the valence of X.

The dialkyl quat is preferably di-(hardened tallow) dimethyl ammonium chloride.

In one embodiment, the quaternary ammonium compound is a compound of general formula (III):

$$[N^+((CH_2)_n\text{-}T\text{-}R_8)_2(R_8)(R_9)]_yX^- \quad (III)$$

wherein:

$R_9$ group is independently selected from $C_1$-$C_4$ alkyl or hydroxylalkyl group;

$R_8$ group is independently selected from $C_1$-$C_{30}$ alkyl or alkenyl group;

T is —C(═O)—O—;

n is an integer from 0 to 5;

X is an anion, for example a chloride, bromide, nitrate or methosulphate ion;

y is the valence of X.

In one embodiment, the quaternary ammonium compound comprises two $C_{12-28}$ alkyl or alkenyl groups connected to the nitrogen head group, more preferably via at least one ester link. In another embodiment, the quaternary ammonium compound has two ester links present.

Preferably, the average chain length of the alkyl or alkenyl group is at least $C_{14}$, more preferably at least $C_{16}$. Even more preferably at least half of the chains have a length of $C_{18}$.

In one embodiment, the alkyl or alkenyl chains are predominantly linear, although a degree of branching, especially mid-chain branching, is within the scope of the invention.

In one embodiment, the ester quaternary ammonium compound is triethanolamine-based quaternary ammonium of general formula (IV):

$$[N^+(C_2H_4\text{—}OOCR_{10})_2(CH_3)(C_2H_4\text{—}OH)](CH_3)_zSO_4^- \quad (IV)$$

wherein $R_{10}$ is a $C_{12}$-$C_{20}$ alkyl group;

z is an integer from 1 to 3.

The quaternary ammonium compound of the present invention may also be a mixture of various quaternary ammonium compounds, notably for instance a mixture of mono-, di- and tri-ester components or a mixture of mono-, and di-ester components, wherein for instance the amount of diester quaternary is comprised between 30 and 99% by weight based on the total amount of the quaternary ammonium compound.

Preferably, the quaternary ammonium compound is a mixture of mono-, di- and tri-ester components, wherein:

the amount of diester quaternary is comprised between 30 and 70% by weight based on the total amount of the quaternary ammonium compound, preferably between 40 and 60% by weight, the amount of monoester quaternary is comprised between 10 and 60% by weight based on the total amount of the quaternary ammonium compound, preferably between 20 and 50% by weight, the amount of triester quaternary is comprised between 1 and 20% by weight based on the total amount of the quaternary ammonium compound.

Alternatively, the quaternary ammonium compound is a mixture of mono- and di-ester components, wherein:

the amount of diester quaternary is comprised between 30 and 99% by weight based on the total amount of the quaternary ammonium compound, preferably between 50 and 99 by weight, the amount of monoester quaternary is comprised between 1 and 50% by weight based on the total amount of the quaternary ammonium compound, preferably between 1 and 20% by weight.

Preferred ester quaternary ammonium compounds of the present invention include:

TET: Di(tallowcarboxyethyl)hydroxyethyl methyl ammonium methylsulfate,

TEO: Di(oleocarboxyethyl)hydroxyethyl methyl ammonium methylsulfate,

TES: Distearyl hydroxyethyl methyl ammonium methylsulfate,

TEHT: Di(hydrogenated tallow-carboxyethyl)hydroxyethyl methyl ammonium methylsulfate, TEP: Di(palmiticcarboxyethyl)hydroxyethyl methyl ammonium methylsulfate, and DEEDMAC: Dimethylbis[2-[(1-oxooctadecyl)oxy]ethyl] ammonium chloride.

In one embodiment, the quaternary ammonium compound of the present invention is present in an amount of from 0.5 to 20 wt % based on the total weight of the composition. In another embodiment, the quaternary ammonium compound of the present invention is present in an amount of from 1 to 10 wt % based on the total weight of the composition. In still another embodiment, the quaternary ammonium compound of the present invention is present in an amount of from 3 to 8 wt % based on the total weight of the composition.

In one aspect, the composition of the present invention comprises at least one cationic polysaccharide. In one embodiment, the composition comprises only one cationic polysaccharide.

The cationic polysaccharide can be obtained by chemically modifying polysaccharides, generally natural polysaccharides. By such modification, cationic side groups can be introduced into the polysaccharide backbone. In one embodiment, the cationic groups borne by the cationic polysaccharide according to the present invention are quaternary ammonium groups.

The cationic polysaccharides of the present invention include but are not limited to:

cationic guar and derivatives thereof, cationic cellulose and derivatives thereof, cationic starch and derivatives thereof, cationic callose and derivatives thereof, cationic xylan and derivatives thereof, cationic mannan and derivatives thereof, cationic galactomannose and derivative thereof.

Cationic celluloses suitable for the present invention include cellulose ethers comprising quaternary ammonium groups, cationic cellulose copolymers or celluloses grafted with a water-soluble quaternary ammonium monomer.

The cellulose ethers comprising quaternary ammonium groups are described in French patent 1,492,597 and in particular include the polymers sold under the names "JR" (JR 400, JR 125, JR 30M) or "LR" (LR 400, LR 30M) by the company Dow. These polymers are also defined in the CTFA dictionary as hydroxyethylcellulose quaternary ammoniums that have reacted with an epoxide substituted with a trimethylammonium group. Suitable cationic celluloses also include LR3000 KC from company Solvay.

The cationic cellulose copolymers or the celluloses grafted with a water-soluble quaternary ammonium monomer are described especially in U.S. Pat. No. 4,131,576, such as hydroxyalkylcelluloses, for instance hydroxymethyl-, hydroxyethyl- or hydroxypropylcelluloses grafted especially with a methacryloyl-ethyltrimethylammonium, methacrylamidopropyltrimethylammonium or dimethyl-diallylammonium salt. The commercial products corresponding to this definition are more particularly the products sold under the names Celquat® L 200 and Celquat® H 100 by the company Akzo Nobel.

Cationic starches suitable for the present invention include the products sold under Polygelo® (cationic starches from Sigma), the products sold under Softgel®, Amylofax® and Solvitose® (cationic starches from Avebe), CATO from National Starch.

Suitable cationic galactomannose include, for example, Fenugreek Gum, Konjac Gum, Tara Gum, Cassia Gum.

In one embodiment, the cationic polysaccharide is a cationic guar. Guars are polysaccharides composed of the sugars galactose and mannose. The backbone is a linear chain of β1,4-linked mannose residues to which galactose residues are 1,6-linked at every second mannose, forming short side-branches. Within the context of the present invention, the cationic guars are cationic derivatives of guars.

In the case of the cationic polysaccharide, such as the cationic guar, the cationic group may be a quaternary ammonium group bearing 3 radicals, which may be identical or different, preferably chosen from hydrogen, alkyl, hydroxyalkyl, epoxyalkyl, alkenyl, or aryl, preferably containing 1 to 22 carbon atoms, more particularly 1 to 14 and advantageously 1 to 3 carbon atoms. The counterion is generally a halogen. One example of the halogen is chlorine.

Examples of the quaternary ammonium group include:

3-chloro-2-hydroxypropyl trimethyl ammonium chloride (CHPTMAC), 2,3-epoxypropyl trimethyl ammonium chloride (EPTAC), diallyldimethyl ammonium chloride (DMDAAC), vinylbenzene trimethyl ammonium chloride, trimethylammonium ethyl metacrylate chloride, methacrylamidopropyltrimethyl ammonium chloride (MAPTAC), and tetraalkylammonium chloride.

One example of the cationic functional group in the cationic polysaccharides, such as the cationic guars, is trimethylamino(2-hydroxyl)propyl, with a counter ion. Various counter ions can be utilized, including but not limited to halides, such as chloride, fluoride, bromide, and iodide, sulfate, notrate, methylsulfate, and mixtures thereof.

The cationic guars of the present invention may be chosen from the group consisting of:

cationic hydroxyalkyl guars, such as cationic hydroxyethyl guar, cationic hydroxypropyl guar, cationic hydroxybutyl guar, and cationic carboxylalkyl guars including cationic carboxymethyl guar, cationic alkylcarboxy guars such as cationic carboxylpropyl guar and cationic carboxybutyl guar, cationic carboxymethylhydroxypropyl guar.

In one embodiment, the cationic guars of the present invention are guars hydroxypropyltrimonium chloride or hydroxypropyl guar hydroxypropyltrimonium chloride.

The cationic polysaccharide, such as the cationic guars, of the present invention may have an average Molecular Weight (Mw) of between 100,000 daltons and 3,500,000 daltons, preferably between 100,000 daltons and 1,500,000 daltons, more preferably between 100,000 daltons and 1,000,000 daltons.

In one embodiment, the composition comprises from 0.05 to 10 wt % of the cationic polysaccharide according to the present invention based on the total weight of the composition. In another embodiment, the composition comprises from 0.05 to 5 wt % of the cationic polysaccharide based on the total weight of the composition. In still another embodiment, the composition comprises from 0.2 to 2 wt % of the cationic polysaccharide based on the total weight of the composition.

In the context of the present application, the term "Degree of Substitution (DS)" of cationic polysaccharides, such as cationic guars, is the average number of hydroxyl groups substituted per sugar unit. DS may notably represent the number of the carboxymethyl groups per sugar unit. DS may be determined by titration.

In one embodiment, the DS of the cationic polysaccharide, such as the cationic guar, is in the range of 0.01 to 1. In another embodiment, the DS of the cationic polysaccharide, such as the cationic guar, is in the range of 0.05 to 1. In still another embodiment, the DS of the cationic polysaccharide, such as the cationic guar, is in the range of 0.05 to 0.2.

In the context of the present application, "Charge Density (CD)" of cationic polysaccharides, such as cationic guars, means the ratio of the number of positive charges on a monomeric unit of which a polymer is comprised to the molecular weight of said monomeric unit.

In one embodiment, the CD of the cationic polysaccharide, such as the cationic guar, is in the range of 0.1 to 3 (meq/gm). In another embodiment, the CD of the cationic polysaccharide, such as the cationic guar, is in the range of 0.1 to 2 (meq/gm). In still another embodiment, the CD of the cationic polysaccharide, such as the cationic guar, is in the range of 0.1 to 1 (meq/gm).

In one aspect, the composition of the present invention comprises at least one nonionic polysaccharide. In one embodiment, the composition comprises only one nonionic polysaccharide.

The nonionic polysaccharide can be a modified nonionic polysaccharide or a non-modified nonionic polysaccharide. The modified nonionic polysaccharide may comprise hydroxyalkylations. In the context of the present application, the degree of hydroxyalkylation (molar substitution or MS) of the modified nonionic polysaccharides means the number of alkylene oxide molecules consumed by the number of free hydroxyl functions present on the polysaccharides. In one embodiment, the MS of the modified nonionic polysaccharide is in the range of 0 to 3. In another embodiment, the MS of the modified nonionic polysaccharide is in the range of 0.1 to 3. In still another embodiment, the MS of the modified nonionic polysaccharide is in the range of 0.1 to 2.

The nonionic polysaccharide of the present invention may be especially chosen from glucans, modified or non-modified starches (such as those derived, for example, from cereals, for instance wheat, corn or rice, from vegetables, for instance yellow pea, and tubers, for instance potato or cassava), amylose, amylopectin, glycogen, dextrans, celluloses and derivatives thereof (methylcelluloses, hydroxyalkylcelluloses, ethylhydroxyethylcelluloses), mannans, xylans, lignins, arabans, galactans, galacturonans, chitin, chitosans, glucuronoxylans, arabinoxylans, xyloglucans, glucomannans, pectic acids and pectins, arabinogalactans, carrageenans, agars, gum arabics, gum tragacanths, ghatti gums, karaya gums, carob gums, galactomannans such as guars and nonionic derivatives thereof (hydroxypropyl guar), and mixtures thereof.

Among the celluloses that are especially used are hydroxyethylcelluloses and hydroxypropylcelluloses. Mention may be made of the products sold under the names Klucel® EF, Klucel® H, Klucel® LHF, Klucel® MF and Klucel® G by the company Aqualon, and Cellosize® Polymer PCG-10 by the company Amerchol, and HEC, HPMC K200, HPMC K35M by the company Ashland.

In one embodiment, the nonionic polysaccharide is a nonionic guar. The nonionic guar can be modified or non-modified. The non-modified nonionic guars include the products sold under the name Vidogum® GH 175 by the company Unipectine and under the names Meypro®-Guar 50 and Jaguar® C by the company Solvay. The modified nonionic guars are especially modified with $C_1$-$C_6$ hydroxyalkyl groups. Among the hydroxyalkyl groups that may be mentioned, for example, are hydroxymethyl, hydroxyethyl, hydroxypropyl and hydroxybutyl groups. These guars are well known in the prior art and can be prepared, for example, by reacting the corresponding alkene oxides such as, for example, propylene oxides, with the guar so as to obtain a guar modified with hydroxypropyl groups.

The nonionic polysaccharide, such as the nonionic guar, of the present invention may have an average Molecular Weight (Mw) of between 100,000 daltons and 3,500,000 daltons, preferably between 500,000 daltons and 3,500,000 daltons.

In one embodiment, the composition comprise from 0.05 to 10 wt % of the nonionic polysaccharide according to the present invention based on the total weight of the composition. In another embodiment, the composition comprises from 0.05 to 5 wt % of the nonionic polysaccharide based on the total weight of the composition. In still another embodiment, the composition comprises from 0.2 to 2 wt % of the nonionic polysaccharide based on the total weight of the composition.

In one embodiment, the ratio of the weight of the quaternary ammonium compound in the composition and the total weight of the cationic polysaccharide and the nonionic polysaccharide in the composition is between 100:1 and 2:1, more preferably, between 30:1 and 5:1.

In one embodiment, the ratio of the weight of the cationic polysaccharide in the composition and the weight of the nonionic polysaccharide in the composition is between 1:10 and 10:1, more preferably, between 1:3 and 3:1.

In another aspect of the present invention, the composition may further comprise a fragrance material or a perfume.

As used herein, the term "fragrance material or perfume" means any organic substance or composition which has a desired olfactory property and is essentially non-toxic. Such substances or compositions include all fragrance material and perfumes that are commonly used in perfumery or in household compositions (laundry detergents, fabric conditioning compositions, soaps, all-purpose cleaners, bathroom cleaners, floor cleaners) or personal care compositions. The compounds involved may be natural, semi-synthetic or synthetic in origin.

Preferred fragrance materials and perfumes may be assigned to the classes of substance comprising the hydrocarbons, aldehydes or esters. The fragrances and perfumes also include natural extracts and/or essences, which may comprise complex mixtures of constituents, i.e. fruits such as almond, apple, cherry, grape, pear, pineapple, orange, lemon, strawberry, raspberry and the like; musk, flower scents such as lavender, jasmine, lily, magnolia, rose, iris, carnation and the like; herbal scents such as rosemary, thyme, sage and the like; woodland scents such as pine, spruce, cedar and the like.

Non limitative examples of synthetic and semi-synthetic fragrance materials and perfumes are:

7-acetyl-1,2,3,4,5,6,7,8-octahydro-1,1,6,7-tetramethylnaphthalene, α-ionone, β-ionone, γ-ionone, α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetralin, 4-acetyl-6-tert-butyl-1,1-dimethylindane, hydroxyphenylbutanone, benzophenone, methyl b-naphthyl ketone, 6-acetyl-1,1,2,3,3,5-hexamethylindane, 5-acetyl-3-isopropyl-1,1,2-,6-tetramethylindane, 1-dodecanal, 4-(4-hydroxy-4-methylpentyl)-3-cyclohex-ene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal and methyl anthranilate, condensation products of hydroxycitronellal and indole, condensation products of phenylacetaldehyde and indole, 2-methyl-3-(para-tert-butylphenyl)propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethylcyclopenta-g-benzopyran, β-naphthol methyl ether, ambroxane, dodecahydro-3a,6,6,9a-tetramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, and tert-butylcyclohexyl acetate.

Particular preference is given to the following:

hexylcinnamaldehyde, 2-methyl-3-(tert-butylphenyl)propionaldehyde, 7-acetyl-1,2,3,4,5,6,7,8-octahydro-1,1,6,7-tetramethylnaphthalene, benzyl salicylate, 7-acetyl-1,1,3,4,4,6-hexamethyltetralin, para-tert-butylcyclohexyl acetate, methyl dihydrojasmonate, (β-naphthol methyl ether, methyl g-naphthyl ketone, 2-methyl-2-(para-isopropylphenyl)propionaldehyde, 1,3,4,6,7,8-hexahydro-4,6,6,7,8,8-hexamethylcyclopenta-g-2-benzopyran, dodecahydro-3a,6,6,9a-tetramethylnaphtho[2,1b]furan, anisaldehyde, coumarin, cedrol, vanillin, cyclopentadecanolide, tricyclodecenyl acetate and tricyclodecenyl propionates.

Other fragrance materials and perfumes are essential oils, resinoids and resins from a large number of sources, such as, Peru balsam, olibanum resinoid, styrax, labdanum resin, nutmeg, cassia oil, benzoin resin, coriander, clary sage, eucalyptus, geranium, lavender, mace extract, neroli, nutmeg, spearmint, sweet violet leaf, valerian and lavandin.

Some or all of the fragrance materials and perfumes may be encapsulated, typical perfume components which it is advantageous to encapsulate, include those with a relatively low boiling point. It is also advantageous to encapsulate perfume components which have a low Clog P (i.e. those which will be partitioned into water), preferably with a Clog P of less than 3.0. As used herein, the term "Clog P" means the calculated logarithm to base 10 of the octanol/water partition coefficient (P).

Further suitable fragrance materials and perfumes include: phenylethyl alcohol, terpineol, linalool, linalyl acetate, geraniol, nerol, 2-(1,1-dimethylethyl)cyclo-hexanol acetate, benzyl acetate, and eugenol.

The fragrance material or perfume can be used as single substance or in a mixture with one another.

Perfumes frequently include solvents or diluents, for example: ethanol, isopropanol, diethylene glycol monoethyl ether, dipropylene glycol, diethyl phthalate and triethyl citrate.

In one embodiment, the composition comprises from 0.01 to 10 wt % of the fragrance material or perfume based on the total weight of the composition. In another embodiment, the composition comprises from 0.1 to 5 wt % of the fragrance material or perfume based on the total weight of the composition. In still another embodiment, the composition comprises from 0.1 to 2 wt % of the fragrance material or perfume based on the total weight of the composition.

In still another aspect of the present invention, there is provided a method for enhancing fragrance or perfume longevity of a composition by adding to the composition (a) a quaternary ammonium compound; (b) a cationic polysaccharide; and (c) a fragrance material or a perfume. In one embodiment, the cationic polysaccharide is a cationic polysaccharide which does not comprise hydroxyalkylation. In another embodiment, the cationic polysaccharide is a cationic guar which is not modified by hydroxyalkylation.

In still another aspect of the present invention, the composition may comprise one or more of the following optional ingredients: dispersing agents, stabilizers, rheology modifying agent, pH control agents, colorants, brighteners, fatty alcohols, fatty acids, dyes, odor control agent, pro-perfumes, cyclodextrins, solvents, preservatives, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents, sun fade inhibitors, insect repellents, anti-allergenic agents, enzymes, flame retardants, water proofing agents, fabric comfort agents, water conditioning agents, stretch resistance agents, and mixtures thereof. Such optional ingredients may be added to the composition in any desired order.

In referring to optional ingredients, without this having to be regarded as an exhaustive description of all possibilities, which, on the other hand, are well known to the person skilled in the art, the following may be mentioned:

a) other products that enhance the softening performance of the composition, such as silicones, amine oxides, anionic surfactants, such as lauryl ether sulphate or lauryl sulphate, sulphosuccinates, amphoteric surfactants, such as amphoacetate, nonionic surfactants such as polysorbate, polyglucoside derivatives, and cationic polymers such as polyquaternium, etc.;
b) stabilising products, such as salts of amines having a short chain, which are quaternised or non-quaternised, for example of triethanolamine, N-methyldiethanolamine, etc., and also non-ionic surfactants, such as ethoxylated fatty alcohols, ethoxylated fatty amines, polysorbate, and ethoxylated alkyl phenols; typically used at a level of from 0 to 15% by weight of the composition;
c) products that improve viscosity control, which is preferably added when the composition comprises high concentrations of fabric conditioning active (such as the quaternary ammonium compound); for example inorganic salts, such as calcium chloride, magnesium chloride, calcium sulphate, sodium chloride, etc.; products which can be used improve the stability in concentrated compositions, such as compounds of the glycol type, such as, glycerol, polyglycerols, ethylene glycol, polyethylene glycols, dipropylene glycol, other polyglycols, etc.; and thickening agents for diluted compositions, for example, natural polymers derived from cellulose, guar, etc. or synthetic polymers, such as acrylamide based polymers (e.g. Flosoft 222 from SNF company), hydrophobically-modified ethoxylated urethanes (e.g. Acusol 880 from Dow company);
d) components for adjusting the pH, which is preferably from 2 to 8, such as any type of inorganic and/or organic acid, for example hydrochloric, sulphuric, phosphoric, citric acid etc.;
e) agents that improve soil release, such as the known polymers or copolymers based on terephthalates;
f) bactericidal preservative agents;
g) other products such as antioxidants, colouring agents, perfumes, germicides, fungicides, anti-corrosive agents, anti-crease agents, opacifiers, optical brighteners, pearl lustre agents, etc.

The composition may comprise a silicone compound. The silicone compound of the invention can be a linear or branched structured silicone polymer. The silicone of the present invention can be a single polymer or a mixture of polymers. Suitable silicone compounds include polyalkyl silicone, amonosilicone, siloxane, polydimethyl siloxane, ethoxylated organosilicone, propoxylated organosilicone, ethoxylated/propoxylated organosilicone and mixture thereof. Suitable silicones include but are not limited to those available from Wacker Chemical, such as Wacker® FC 201 and Wacker® FC 205.

The composition may comprise a cross-linking agent. Following is a non-restrictive list of cross-linking agents: methylene bisacrylamide (MBA), ethylene glycol diacrylate, polyethylene glycol dimethacrylate, diacrylamide, triallylamine, cyanomethylacrylate, vinyl oxyethylacrylate or methacrylate and formaldehyde, glyoxal, compounds of the glycidyl ether type such as ethyleneglycol diglycidyl ether, or the epoxydes or any other means familiar to the expert permitting cross-linking.

The composition may comprise at least one surfactant system. A variety of surfactants can be used in the composition of the invention, including cationic, nonionic and/or amphoteric surfactants, which are commercially available from a number of sources. For a discussion of surfactants, see Kirk-Othmer, Encyclopedia of Chemical Technology, Third Edition, volume 8, pages 900-912. Preferably, the composition comprises a surfactant system in an amount effective to provide a desired level of softness to fabrics, preferably between about 5 and about 10 wt %.

The composition may comprise a dye, such as an acid dye, a hydrophobic dye, a basic dye, a reactive dye, a dye conjugate. Suitable acid dyes include azine dyes such as acid blue 98, acid violet 50, and acid blue 59, non-azine acid dyes such as acid violet 17, acid black 1 and acid blue 29. Hydrophobic dyes selected from benzodifuranes, methine, triphenylmethanes, napthalimides, pyrazole, napthoquinone, anthraquinone and mono-azo or di-azo dye chromophores. Suitable hydrophobic dyes are those dyes which do not contain any charged water solubilising group. The hydrophobic dyes may be selected from the groups of disperse and solvent dyes. Blue and violet anthraquinone and mono-azo dye are preferred. Basic dyes are organic dyes which carry a net positive charge. They deposit onto cotton. They are of particular utility for used in composition that contain predominantly cationic surfactants. Dyes may be selected from the basic violet and basic blue dyes listed in the Colour Index International. Preferred examples include triarylmethane basic dyes, methane basic dye, anthraquinone basic dyes, basic blue 16, basic blue 65, basic blue 66, basic blue 67, basic blue 71, basic blue 159, basic violet 19, basic violet 35, basic violet 38, basic violet 48; basic blue 3, basic blue 75, basic blue 95, basic blue 122, basic blue 124, basic blue 141. Reactive dyes are dyes which contain an organic group capable of reacting with cellulose and linking the dye to cellulose with a covalent bond. Preferably the reactive group is hydrolysed or reactive group of the dyes has been reacted with an organic species such as a polymer, so as to the link the dye to this species. Dyes may be selected from the reactive violet and reactive blue dyes listed in the Colour Index International. Preferred examples include reactive blue 19, reactive blue 163, reactive blue 182 and reactive blue, reactive blue 96. Dye conjugates are formed by binding direct, acid or basic dyes to polymers or particles via physical forces. Dependent on the choice of polymer or particle they deposit on cotton or synthetics. A description is given in WO2006/055787. Particularly preferred dyes are: direct violet 7, direct violet 9, direct violet 11, direct violet 26, direct violet 31, direct violet 35, direct violet 40, direct violet 41, direct violet 51, direct violet 99, acid blue 98, acid violet 50, acid blue 59, acid violet 17, acid black 1, acid blue 29, solvent violet 13, disperse violet 27 disperse violet 26, disperse violet 28, disperse violet 63, disperse violet 77 and mixtures thereof. The solid composition of the present invention may comprise one or more perfumes. The perfume is preferably present in an amount between 0.01 and 20 wt %, more preferably between 0.05 and 10 wt %, even more preferably between 0.05 and 5 wt %, most preferably between 0.05 and 1.5 wt %, based on the total weight of the solid composition.

The composition may comprise an antimicrobial. The antimicrobial may be a halogenated material. Suitable halogenated materials include 5-chloro-2-(2,4-dichlorophenoxy) phenol, o-Benzyl-p-chloro-phenol, and 4-chloro-3-methylphenol. Alternatively The antimicrobial may be a non-halogenated material. Suitable non-halogenated materials include 2-Phenylphenol and 2-(1-Hydroxy-1-methylethyl)-5-methylcyclohexanol. Phenyl ethers are one preferred subset of the antimicrobials. The antimicrobial may also be a bi-halogenated compound. Most preferably this comprises 4-4' dichloro-2-hydroxy diphenyl ether, and/or 2,2-dibromo-3-nitrilopropionamide (DBNPA).

The composition may also comprise preservatives. Preferably only those preservatives that have no, or only slight, skin sensitizing potential are used. Examples are phenoxy ethanol, 3-iodo-2-propynylbutyl carbamate, sodium N-(hydroxymethyl)glycinate, biphenyl-2-ol as well as mixtures thereof.

The composition may also comprise antioxidants to prevent undesirable changes caused by oxygen and other oxidative processes to the solid composition and/or to the treated textile fabrics. This class of compounds includes, for example, substituted phenols, hydroquinones, pyrocatechols, aromatic amines and vitamin E.

The composition may comprise a hydrophobic agent. The hydrophobic agent may be present in an amount of from 0.05 to 1.0 wt %, preferably from 0.1 to 0.8 wt %, more preferably from 0.2 to 0.7 and most preferably from 0.4 to 0.7 wt % by weight of the total composition, for example from 0.2 to 0.5 wt %. The hydrophobic agent may have a ClogP of from 4 to 9, preferably from 4 to 7, most preferably from 5 to 7.

Suitable hydrophobic agents include esters derived from the reaction of a fatty acid with an alcohol. The fatty acid preferably has a carbon chain length of from $C_8$ to $C_{22}$ and may be saturated or unsaturated, preferably saturated. Some examples include stearic acid, palmitic acid, lauric acid and myristic acid. The alcohol may be linear, branched or cyclic. Linear or branched alcohols have a preferred carbon chain length of from 1 to 6. Preferred alcohols include methanol, ethanol, propanol, isopropanol, sorbitol. Preferred hydrophobic agents include methyl esters, ethyl esters, propyl esters, isopropyl esters and sorbitan esters derived from such fatty acids and alcohols.

Non-limiting examples of suitable hydrophobic agents include methyl esters derived from fatty acids having a carbon chain length of from at least $C_{10}$, ethyl esters derived from fatty acids having a carbon chain length of from at least $C_{10}$, propyl esters derived from fatty acids having a carbon chain length of from at least $C_8$, isopropyl esters derived from fatty acids having a carbon chain length of from at least $C_8$, sorbitan esters derived from fatty acids having a carbon chain length of from at least $C_{16}$, and alcohols with a carbon chain length greater than $C_{10}$. Naturally occurring fatty acids commonly have a carbon chain length of up to $C_{22}$.

Some preferred materials include methyl undecanoate, ethyl decanoate, propyl octanoate, isopropyl myristate, sorbitan stearate and 2-methyl undecanol, ethyl myristate, methyl myristate, methyl laurate, isopropyl palmitate and ethyl stearate; more preferably methyl undecanoate, ethyl decanoate, isopropyl myristate, sorbitan stearate, 2-methyl undecanol, ethyl myristate, methyl myristate, methyl laurate and isopropyl palmitate.

Non-limiting examples of such materials include methyl undecanoate, ethyl decanoate, propyl octanoate, isopropyl myristate, sorbitan stearate and 2-methyl undecanol; preferably methyl undecanoate, ethyl decanoate, isopropyl myristate, sorbitan stearate and 2-methyl undecanol.

The composition may comprise an antifoam agent. The antifoam agent may be present in an amount of from 0.025 to 0.45 wt %, preferably 0.03 to 0.4 wt %, most preferably from 0.05 to 0.35 wt %, for example 0.07 to 0.4 wt %, by weight of the total composition and based on 100 percent antifoam activity. A wide variety of materials may be used as the antifoam agent, and antifoam agents are well known to those skilled in the art. See, for example, Kirk Othmer Encyclopedia of Chemical Technology, Third Edition, Volume 7, pages 430-447 (John Wiley and Sons, Inc., 1979).

Suitable antifoam agents include, for example, silicone antifoam compounds, alcohol antifoam compounds, for example 2-alkyl alcanol antifoam compounds, fatty acids, paraffin antifoam compounds, and mixtures thereof. By antifoam compound it is meant herein any compound or mixtures of compounds which act such as to depress the foaming or sudsing produced by a solution of a detergent composition, particularly in the presence of agitation of that solution.

Particularly preferred antifoam agents for use herein are silicone antifoam compounds defined herein as any antifoam compound including a silicone component. Many such silicone antifoam compounds also contain a silica component. The term ""silicone"" as used herein, and in general throughout the industry, encompasses a variety of relatively high molecular weight polymers containing siloxane units and hydrocarbyl group of various types like the polyorganosiloxane oils, such as polydimethyl-siloxane, dispersions or emulsions of polyorganosiloxane oils or resins, and combinations of polyorganosiloxane with silica particles wherein the polyorganosiloxane is chemisorbed or fused onto the silica. Silica particles are often hydrophobed, e.g. as Trimethylsiloxysilicate. Silicone antifoam agents are well known in the art and are, for example, disclosed in U.S. Pat. No. 4,265,779, issued May 5, 25 1981 and European Patent Application No. 89307851. 9, published Feb. 7, 1990. Other silicone antifoam compounds are disclosed in U.S. Pat. No. 3,455,839. Silicone defoamers and suds controlling agents in granular detergent compositions are disclosed in U.S. Pat. Nos. 3,933,672, 35 and in U.S. Pat. No. 4,652,392 issued Mar. 24, 1987. Examples of suitable silicone antifoam compounds are the combinations of polyorganosiloxane with silica particles commercially available from Dow Corning, Wacker Chemie and Momentive.

Other suitable antifoam compounds include the monocarboxylic fatty acids and soluble salts thereof. These materials are described in U.S. Pat. No. 2,954,347. The monocarboxylic fatty acids, and salts thereof, for use as antifoam agents typically have hydrocarbyl chains of about 10 to about 24 carbon atoms, preferably about 12 to about 18 carbon atoms like the tallow amphopolycarboxyglycinate commercially available under the trade name TAPAC. Suitable salts include the alkali metal salts such as sodium, potassium, and lithium salts, and ammonium and alkanolammonium salts.

Other suitable antifoam compounds include, for example, high molecular weight hydrocarbons such as paraffin, light petroleum odourless hydrocarbons, fatty esters (e. g. fatty acid triglycerides, glyceryl derivatives, polysorbates), fatty acid esters of monovalent alcohols, aliphatic $C_{18-40}$ ketones (e. g. stearone)N-alkylated amino triazines such as tri- to hexa-10 alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl phosphates such as monostearyl alcohol phosphate ester and monostearyl di-alkali metal (e.g., K, Na, and Li) phosphates and phosphate esters, and nonionic polyhydroxyl derivatives. The hydrocarbons, such as paraffin and 15 haloparaffin, can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferably having a melting point below about 100° C. Hydrocarbon suds suppressers are described, for example, in U.S. Pat. No. 4,265,779. The hydrocarbons, thus, include aliphatic, alicyclic, aromatic, and heterocyclic saturated or unsaturated hydrocarbons having from about 12 to about 70 carbon atoms. The term "paraffin", as used in this suds suppresser discussion, is intended to include mixtures of true paraffins and cyclic hydrocarbons. Copolymers of ethylene oxide and propylene oxide, particularly the mixed ethoxylated/propoxylated fatty alcohols with an alkyl chain length of from about 10 to about 16 carbon atoms, a degree of ethoxylation of from about 3 to about 30 and a degree of propoxylation of from about 1 to about 10, are also suitable antifoam compounds for use herein.

Other antifoam agents useful herein comprise the secondary alcohols (e.g., 2-alkyl alkanols as described in DE 40 21 265) and mixtures of such alcohols with silicone oils, such as the silicones disclosed in U.S. Pat. No. 4,798,679 and EP 150,872. The secondary alcohols include the $C_6$-$C_{16}$ alkyl alcohols having a $C_1$-$C_{16}$ chain like the 2-Hexyldecanol commercially available under the trade name ISOFOL16, 2-Octyldodecanol commercially available under the tradename ISOFOL20, and 2-butyl octanol, which is available under the trademark ISOFOL 12 from Condea. A preferred alcohol is 2-butyl octanol, which is available from Condea under the trademark ISOFOL 12. Mixtures of secondary alcohols are available under the trademark ISALCHEM 123 from Enichem. Mixed antifoam agents typically comprise mixtures of alcohol to silicone at a weight ratio of about 1:5 to about 5:1. Further preferred antifoam agents are Silicone SRE grades and Silicone SE 47M, SE39, SE2, SE9 and SE10 available from Wacker Chemie; BF20+, DB310, DC1410, DC1430, 22210, HV495 and Q2-1607 ex Dow Corning; FD20P and BC2600 supplied by Basildon; and SAG 730 ex Momentive. Other suitable antifoams, described in the literature such as in Hand Book of Food Additives, ISBN 0-566-07592-X, p. 804, are selected from dimethicone, poloxamer, polypropyleneglycol, tallow derivatives, and mixtures thereof.

Preferred among the antifoam agents described above are the silicone antifoams agents, in particular the combinations of polyorganosiloxane with silica particles.

The composition may comprise an antifreeze agent. The antifreeze agent as described below is used to improve freeze recovery of the composition.

The antifreeze active may be an alkoxylated nonionic surfactant having an average alkoxylation value of from 4 to 22, preferably from 5 to 20 and most preferably from 6 to 20. The alkoxylated nonionic surfactant may have a ClogP of from 3 to 6, preferably from 3.5 to 5.5. Mixtures of such nonionic surfactants may be used.

Suitable nonionic surfactants which can be used as the antifreeze agent include in particular the reaction products of compounds having a hydrophobic group and a reactive hydrogen atom, for example aliphatic alcohols, acids, or alkyl phenols with alkylene oxides, preferably ethylene oxide either alone or with propylene oxide.

Suitable antifreeze agents may also be selected from alcohols, diols and esters. A particularly preferred additional antifreeze agent is monopropylene glycol (MPG). Other nonionic antifreeze materials, which are outside the scope of the non-ionic antifreeze component of the present invention but which may be additionally included in the compositions of the invention include alkyl polyglycosides, ethoxylated castor oils, and sorbitan esters.

Further suitable antifreeze agents are those disclosed in EP 0018039 including paraffins, long chain alcohols and several esters for example glycerol mono stearate, iso butyl stearate and iso propyl palmitate. Also materials disclosed in U.S. Pat. No. 6,063,754 such as $C_{10-12}$ isoparaffins, isopropyl myristate and dioctyladapate.

The composition may comprise one or more viscosity control agents, such as polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

The composition may comprise a stabilizer. The stabilizer may be a mixture of a water-insoluble, cationic material and a nonionic material selected from hydrocarbons, fatty acids, fatty esters and fatty alcohols.

The composition may comprise a floc prevention agent, which may be a nonionic alkoxylated material having an HLB value of from 8 to 18, preferably from 11 to 16, more preferably from 12 to 16 and most preferably 16. The nonionic alkoxylated material can be linear or branched, preferably linear. Suitable floc prevention agents include nonionic surfactants. Suitable nonionic surfactants include addition products of ethylene oxide and/or propylene oxide with fatty alcohols, fatty acids and fatty amines. The floc prevention agent is preferably selected from addition products of (a) an alkoxide selected from ethylene oxide, propylene oxide and mixtures thereof with (b) a fatty material selected from fatty alcohols, fatty acids and fatty amines.

The composition may comprise a polymeric thickening agent. Suitable polymeric thickening agents are water soluble or dispersable. Monomers of the polymeric thickening agent may be nonionic, anionic or cationic. Following is a non-restrictive list of monomers performing a nonionic function: acrylamide, methacrylamide, N-Alkyl acrylamide, N-vinyl pyrrolidone, N-vinyl formamide, N-vinyl acetamide, vinylacetate, vinyl alcohol, acrylate esters, allyl alcohol. Following is a non-restrictive list of monomers performing an anionic function: acrylic acid, methacrylic acid, itaconic acid, crotonic acid, maleic acid, fumaric acid, as well as monomers performing a sulfonic acid or phosphonic acid functions, such as 2-acrylamido-2-methyl propane sulfonic acid (ATBS) etc. The monomers may also contain hydrophobic groups. Suitable cationic monomers are selected from the group consisting of the following monomers and derivatives and their quaternary or acid salts: dimethylaminopropylmethacrylamide, dimethylaminopropylacrylamide, diallylamine, methyldiallylamine, dialkylaminoalkyl-acrylates and methacrylates, dialkylaminoalkyl-acrylamides or -methacrylamides.

Polymeric thickening agents particularly useful in the composition of the invention include those described in WO2010/078959. These are crosslinked water swellable cationic copolymers having at least one cationic monomer and optionally other nonionic and/or anionic monomers. Preferred polymers of this type are copolymers of acrylamide and trimethylaminoethylacrylate chloride.

Preferred polymers comprise less than 25 percent of water soluble polymers by weight of the total polymer, preferably less than 20 percent, and most preferably less than 15 percent, and a cross-linking agent concentration of from 500 ppm to 5000 ppm relative to the polymer, preferably from 750 ppm to 5000 ppm, more preferably from 1000 to 4500 ppm (as determined by a suitable metering method such as that described on page 8 of patent EP 343840). The cross-linking agent concentration must be higher than about 500 ppm relative to the polymer, and preferably higher than about 750 ppm when the crosslinking agent used is the methylene bisacrylamide, or other cross-linking agents at concentrations that lead to equivalent cross-linking levels of from 10 to 10,000 ppm.

The composition of the present invention may be prepared by any mixing means known by a person skilled in the art. Preferably, the composition is prepared by the following procedure:

(i) providing an aqueous dispersion of a mixture of the cationic polysaccharide and the nonionic polysaccharide. Optionally, other additives may also be added in the aqueous dispersion. Preferably, agitation and/or heating are provided to facilitate the process. In one preferred embodiment, the pH value of the aqueous dispersion of the polysaccharides is adjusted to be in the range of 3.5 to 5 by using an acidic agent. The fragrance or perfume may be added at this stage;

(ii) mixing the quaternary ammonium compound with the aqueous dispersion obtained in (i), to give rise to the composition of the present invention. Preferably, the quaternary ammonium compound is melt by heating before the mixing. Agitation and heating can also be provided to facilitate the process.

Preferably, the pH value of the composition obtained in (ii) is adjusted to be in the range of 2.5 to 8, by using a suitable acidic agent or basic agent. Optional additives may also be added to the composition at this stage.

The composition of the present invention may take a variety of physical forms including liquid, liquid-gel, paste-like, foam in either aqueous or non-aqueous form, and any other suitable form known by a person skilled in the art. For better dispersibility, a preferred form of the composition is a liquid form, and in the form of an aqueous dispersion in water. When in a liquid form, the composition may also be dispensed with dispensing means such as a sprayer or aerosol dispenser.

In one preferred embodiment, the composition of the present invention is a liquid fabric conditioning composition. When in the liquid form, the composition may contain from 0.1% to 20% by weight of a fabric conditioning agent, in the case of standard (diluted) fabric softener but may contain higher levels from up to 30% or even 40% by weight in the case of very concentrated fabric conditioning compositions. The composition usually also contains water and other additives, which may provide the balance of the composition. Suitable liquid carriers are selected from water, organic solvents and mixtures thereof. The liquid carrier employed in the composition is preferably at least primarily water due to its low cost, safety, and environmental compatibility. Mixtures of water and organic solvent may be used. Preferred organic solvents are; monohydric alcohol, such as ethanol, propanol, iso-propanol or butanol; dihydric alcohol, such as glycol; trihydric alcohols, such as glycerol, and polyhydric (polyol) alcohols.

Accordingly, in one aspect, the present invention also provides a method for preparing a liquid fabric conditioning composition. The liquid fabric conditioning composition may be customarily prepared by melting the fabric conditioning actives and mixing them with other ingredients, and then adding the mixture to hot water, with agitation to homogenize and disperse the water-insoluble ingredients.

In another aspect, the present invention also concerns the use of the composition according to the present invention as a textile care agent.

In still another aspect, the present invention also provides a method for conditioning a fabric comprising the step of contacting an aqueous medium containing the composition of the present invention with the fabric.

The composition of the present invention can be used in a so-called rinse process. Typically the fabric conditioning composition of the present invention is added during the rinse cycle of an automatic laundry machine (such as an automatic fabric washing machine). One aspect of the invention provides dosing the composition of the present invention during the rinse cycle of the automatic laundry washing machine. Another aspect of the invention provides for a kit comprising the composition of the present invention and optionally instructions for use.

When being used in the rinse process, the composition is first diluted in an aqueous rinse bath solution. Subsequently, the laundered fabrics which have been washed with a detergent liquor and optionally rinsed in a first inefficient rinse step ("inefficient" in the sense that residual detergent and/or soil may be carried over with the fabrics), are placed in the rinse solution with the diluted composition. Of course, the composition may also be incorporated into the aqueous bath once the fabrics have been immersed therein. Following that step, agitation is applied to the fabrics in the rinse bath solution causing the suds to collapse, and residual soils and surfactant is to be removed. The fabrics can then be optionally wrung before drying.

Accordingly, in still another aspect, there is provided a method for rinsing fabrics, which comprises the steps of contacting the fabrics, preferably previously washed in a detergent liquor, with the composition according to the present invention. The subject-matter of the invention also includes the use of the composition of the present invention to impart fabric softness to fabrics; notably for fabrics that have been washed in a high suds detergent solution, while providing in the rinse a reduction of suds or foaming and without the creation of undesirable flocs.

In still another aspect, the present invention also concerns a method for softening a fabric comprising contacting an aqueous medium comprising the composition of the present invention with the fabric during a rinse cycle of a fabric washing machine.

This rinse process may be performed manually in basin or bucket, in a non-automated washing machine, or in an automated washing machine. When hand washing is performed, the laundered fabrics are removed from the detergent liquor and wrung out. The composition of the present invention may be then added to fresh water and the fabrics are then, directly or after an optional inefficient first rinse step, rinsed in the water containing the composition according to the conventional rinsing habit. The fabrics are then dried using conventional means.

In still another aspect of the present invention, there is provided a recipient containing a composition of the present invention. The recipient allows easy transportation of the composition, and distribution of the composition to users as well. The recipient of the present invention may be a tank, a bottle, a box, a tube, or the like. The recipient may be made of various materials, including and not being limited to plastic, rubber, metal, synthetic fiber, glass, ceramic material, wood and paper based material. The recipient may be in any shape which is easy for handling and transportation, including and not being limited to cubic, cuboidal, cylindrical, conical and irregular shape. The recipient preferably has at least one opening for the composition to be filled in or taken out. Preferably, the opening is on a top of the recipient. The recipient may also have a cover for closing the opening. The cover may be a lid, a cap such as a threaded cap, a sealing, a plug, a spigot, or the like.

Should the disclosure of any patents, patent applications, and publications which are incorporated herein by reference conflict with the description of the present application to the extent that it may render a term unclear, the present description shall take precedence.

The following examples are included to illustrate embodiments of the invention. Needless to say, the invention is not limited to the described examples.

EXAMPLES

The compositions in the following samples were prepared by using the material and procedure as described below:

Materials

TEP: Di(palmiticcarboxyethyl)hydroxyethyl methyl ammonium methylsulfate; Fentacare TEP softener (from Solvay);

DHT: Dihydrogenated tallowdimethylammonium chloride, Fentacare® DHT softener (from Solvay);

Nonionic Guar 1: a hydroxypropyl guar having a molecular weight of between 2,000,000 and 3,000,000 daltons;

Nonionic Guar 2: a naive guar having an average molecular weight of about 2,000,000 daltons (from Sovlay);

Cationic Guar: a guar hydroxypropyltrimonium chloride having a molecular weight below 1,500,000 daltons;

NEC: a hydroxyethyl cellulose (from Ashland);

HPMC K200: a hydroxylpropyl methyl cellulose (from Ashland);

HPMC K35M: a hydroxylpropyl methyl cellulose (from Ashland);

LR3000KC: a quaternized cellulose (from Solvay);

LR400: a quaternized cellulose (from Solvay);

Konjac Gum: a quaternized galactomannose (from Foodchem International Corporation);

Fenugreek Gum: a quaternized galactomannose (China Zhengzhou Ruiheng Corporation);

Tara Gum: a quaternized galactomannose (from Foodchem International Corporation);

Cassia Gum: a quaternized galactomannose (from Lubrizol);

CATO: a quaternized starch (from National Starch).

Procedure for the Preparation of Fabric Conditioning Compositions

1. One or more guars, water and additives (if any) were added into a first beaker, then heated up to 55° C. with stirring.
2. TEP was melt in a second beaker at 55° C. and then added into the first beaker, then the mixture was agitated for at least 5 mins.
3. The mixture of step (2) was cooled down to 35° C. and preservatives and fragrance were added into the mixture.
4. The pH value of the mixture was adjusted to target value with 10 wt % NaOH water solution.

Example 1: Softening Performance Test

Fabric conditioning composition samples were prepared according to the following formulation (Shown in Table 1) by using the above mentioned procedure:

TABLE 1

| | Sample 1 | Sample 2 | Sample 3 | Sample 4 |
|---|---|---|---|---|
| TEP (wt %) | 4 | 4 | 4 | 4 |
| Nonionic Guar 1 (wt %) | 0 | 0.2 | 0 | 0.4 |

TABLE 1-continued

| | Sample 1 | Sample 2 | Sample 3 | Sample 4 |
|---|---|---|---|---|
| Cationic Guar (wt %) | 0 | 0.2 | 0.4 | 0 |
| Water | Balance | Balance | Balance | Balance |
| Total (wt %) | 100 | 100 | 100 | 100 |

For the softening performance test, 2 grams of each of the samples was diluted in 1 liter water. Then towels were immersed into the water containing different samples (5 towels for each sample), respectively, for 10 mins. Then, the treated towels were drawn out, span for 5 mins and dried overnight. Then, the softness of each treated towel was evaluated by five panellists independently in which the panellist touched the treated towel and felt the softness of the treated towel (double-blinded test). The softness of the treated towels was rated in a scale of 1 to 5, wherein 1 represents the lowest softness and 5 represents the highest softness. Subsequently, the average softness rating of the towels treated by the same sample (n=25) was calculated.

TABLE 2

| | Sample 1 | Sample 2 | Sample 3 | Sample 4 |
|---|---|---|---|---|
| Average softness rating | 4.0 | 4.4 | 3.1 | 3.8 |

As illustrated in Table 2, Sample 2 provided enhanced softening performance compared to Samples 1, 3 and 4. Notably, Sample 2 provided enhanced softening performance compared to the samples comprising TEP and a cationic guar alone (Sample 3) or TEP and a nonionic guar alone (Sample 4), wherein the total amounts of the polysaccharide(s) present in these samples (Samples 2 to 4) were same.

Example 2: Perfume Longevity Test for Wet Towels

Fabric conditioning composition samples were prepared according to the following formulation (shown in Table 3) by using the above mentioned procedure:

TABLE 3

| | Sample 5 | Sample 6 |
|---|---|---|
| TEP (wt %) | 4 | 10 |
| Perfume: Fragrance Red Jewel (from Symrise) (wt %) | 0.6 | 0.6 |
| Preservative: Kathon CG (wt %) | 0.1 | 0.1 |

TABLE 3-continued

| | Sample 5 | Sample 6 |
|---|---|---|
| Nonionic Guar 1 (wt %) | 0.2 | 0 |
| Cationic Guar (wt %) | 0.2 | 0 |
| Water | Balance | Balance |
| Total (wt %) | 100 | 100 |

For the perfume longevity test, 2 gram of each of the samples was diluted in 1 liter water. Then towels were immersed into the water containing different samples (one towel for each sample), respectively, for 10 mins. Then, the treated towels were drawn out, span for 5 mins, and subsequently sealed in zip bags respectively for preventing the emission of the odour of the perfume. Then, the towels were taken out and the strength of the odour of each treated towel was immediately rated by 10 panellists independently (double-blinded test). The strength of the odour of the treated towels was rated in a scale of 1 to 4, wherein 1 represents the weakest odour and 4 represents the strongest odour. Subsequently, the average odour strength rating of the towels treated by the same sample (n=10) was calculated.

Example 3: Perfume Longevity Test for Dry Towels

The fabric conditioning composition samples were prepared and the test was carried out in the same manner as described in Example 2, expect that the towels, after the spinning, were dried overnight before the odour of the towels was rated.

TABLE 4

| | Sample 5 | Sample 6 |
|---|---|---|
| | Wet towel test | |
| Average odour strength rating | 2.3 | 1.4 |
| | Dry towel test | |
| Average odour strength rating | 3.1 | 2.3 |

As illustrated in Table 4, in both the wet towel test and the dry towel test, the towels treated by Sample 5 exhibited stronger odour, after the treatment (after the treatment and the drying for the dry towel test), compared to those treated by Sample 6. The results indicated that the addition of the cationic guar and the nonionic guar in the fabric conditioning composition provided improved perfume longevity.

Example 4: Softening Performance Test and Perfume Longevity Test for Various Polysaccharides Fabric conditioning composition samples were prepared according to the formulation shown in Table 5 below:

TABLE 5

| | Quat (TEP) | Nonionic polysaccharide | Cationic polysaccharide | Perfume (Fragrance Red Jewel) | Water |
|---|---|---|---|---|---|
| Sample 7 | 4 wt % | HEC (0.2 wt %) | Cationic Guar (0.2 wt %) | 0.6 wt % | Balance to 100 wt % |

TABLE 5-continued

| | Quat (TEP) | Nonionic polysaccharide | Cationic polysaccharide | Perfume (Fragrance Red Jewel) | Water |
|---|---|---|---|---|---|
| Sample 8 | 4 wt % | HPMC K200 (0.2 wt %) | Cationic Guar (0.2 wt %) | 0.6 wt % | Balance to 100 wt % |
| Sample 9 | 4 wt % | HPMC K35M (0.2 wt %) | Cationic Guar (0.2 wt %) | 0.6 wt % | Balance to 100 wt % |
| Sample 10 | 4 wt % | Nonionic Guar 2 (0.2 wt %) | Cationic Guar (0.2 wt %) | 0.6 wt % | Balance to 100 wt % |
| Sample 11 | 4 wt % | Nonionic Guar 1 (0.2 wt %) | LR3000KC (0.2 wt %) | 0.6 wt % | Balance to 100 wt % |
| Sample 12 | 4 wt % | Nonionic Guar 1 (0.2 wt %) | LR400 (0.2 wt %) | 0.6 wt % | Balance to 100 wt % |
| Sample 13 | 4 wt % | Nonionic Guar 1 (0.2 wt %) | Konjac Gum (0.2 wt %) | 0.6 wt % | Balance to 100 wt % |
| Sample 14 | 4 wt % | Nonionic Guar 1 (0.2 wt %) | Fenugreek Gum (0.2 wt %) | 0.6 wt % | Balance to 100 wt % |
| Sample 15 | 4 wt % | Nonionic Guar 1 (0.2 wt %) | Tara Gum (0.2 wt %) | 0.6 wt % | Balance to 100 wt % |
| Sample 16 | 4 wt % | Nonionic Guar 1 (0.2 wt %) | Cassia Gum (0.2 wt %) | 0.6 wt % | Balance to 100 wt % |
| Sample 17 | 4 wt % | Nonionic Guar 1 (0.2 wt %) | CATO (0.2 wt %) | 0.6 wt % | Balance to 100 wt % |
| Sample 18 | 4 wt % | Nonionic Guar 1 (0.4 wt %) | — | 0.6 wt % | Balance to 100 wt % |
| Sample 19 | 4 wt % | HEC (0.4 wt %) | — | 0.6 wt % | Balance to 100 wt % |
| Sample 20 | 4 wt % | HPMC K200 (0.4 wt %) | — | 0.6 wt % | Balance to 100 wt % |
| Sample 21 | 4 wt % | HPMC K35M (0.4 wt %) | — | 0.6 wt % | Balance to 100 wt % |
| Sample 22 | 4 wt % | Nonionic Guar 2 (0.4 wt %) | — | 0.6 wt % | Balance to 100 wt % |
| Sample 23 | 4 wt % | — | Cationic Guar (0.4 wt %) | 0.6 wt % | Balance to 100 wt % |
| Sample 24 | 4 wt % | — | LR3000KC (0.4 wt %) | 0.6 wt % | Balance to 100 wt % |
| Sample 25 | 4 wt % | — | LR400 (0.4 wt %) | 0.6 wt % | Balance to 100 wt % |
| Sample 26 | 4 wt % | — | Konjac Gum (0.4 wt %) | 0.6 wt % | Balance to 100 wt % |
| Sample 27 | 4 wt % | — | Fenugreek Gum (0.4 wt %) | 0.6 wt % | Balance to 100 wt % |
| Sample 28 | 4 wt % | — | Tara Gum (0.4 wt %) | 0.6 wt % | Balance to 100 wt % |
| Sample 29 | 4 wt % | — | Cassia Gum (0.4 wt %) | 0.6 wt % | Balance to 100 wt % |
| Sample 30 | 4 wt % | — | CATO (0.4 wt %) | 0.6 wt % | Balance to 100 wt % |

The samples were subject to fabric softening test and perfume longevity test (dry towels) which were conducted according to the methods as described above. Results are shown in Table 6 below.

TABLE 6

| | Average softness rating | Average odour strength rating |
|---|---|---|
| Sample 7 | 4.25 | 3 |
| Sample 8 | 4.4 | 2.9 |
| Sample 9 | 4.4 | 2.7 |
| Sample 10 | 4.4 | 2.9 |
| Sample 11 | 4.4 | 3.2 |
| Sample 12 | 4.25 | 2.5 |
| Sample 13 | 4.25 | 2.6 |
| Sample 14 | 4.25 | 2.7 |
| Sample 15 | 4.4 | 2.8 |
| Sample 16 | 4.4 | 2.9 |
| Sample 17 | 4.4 | 2.5 |
| Sample 18 | 3.8 | 2.1 |
| Sample 19 | 3.7 | 1.8 |
| Sample 20 | 3.4 | 1.9 |
| Sample 21 | 3.5 | 2.1 |
| Sample 22 | 4 | 2 |
| Sample 23 | 3.1 | 1.5 |
| Sample 24 | 3 | 1.4 |
| Sample 25 | 2.5 | 1.3 |
| Sample 26 | 2.7 | 1.6 |
| Sample 27 | 3.3 | 1.5 |
| Sample 28 | 3 | 1.7 |
| Sample 29 | 3.5 | 1.8 |
| Sample 30 | 3 | 1.6 |

As illustrated by the results in Table 6, samples which contain a quat, a cationic polysaccharide and a nonionic polysaccharide exhibited enhanced fabric softening performance and improved perfume delivery in comparison to those containing a quat and a single polysaccharide.

The invention claimed is:

1. A method for enhancing fragrance or perfume longevity of a composition by adding to the composition (a) 3 to 8 wt. % of a quaternary ammonium compound; (b) 0.2 to 2 wt. % of a cationic polysaccharide; (c) 0.2 to 2 wt. % of a nonionic polysaccharide; and (d) 0.01 wt. % to 10 wt. % of a fragrance material or perfume, wherein the quaternary ammonium compound has the general formula (III):

$$[N^+((CH_2)_n\text{-}T\text{-}R_8)_2(R_8)(R_9)]_yX^- \quad \text{(III)}$$

wherein:

$R_9$ group is independently selected from $C_1$-$C_4$ alkyl or hydroxylalkyl group;

$R_8$ group is independently selected from $C_{12}$-$C_{28}$ alkyl or alkenyl group;

T is —C(=O)—O—;

n is an integer from 0 to 5;

X is an anion;

y is the valence of X.

2. The method according to claim 1, wherein the cationic polysaccharide is a cationic guar.

3. The method according to claim 1, wherein the nonionic polysaccharide is a nonionic guar.

4. The method according to claim 1, wherein the cationic polysaccharide has an average molecular weight of between 100,000 daltons and 1,500,000 daltons.

5. The method according to claim 1, wherein the quaternary ammonium compound has the general formula (IV):

$$[N^+(C_2H_4\text{—}OOCR_{10})_2(CH_3)(C_2H_4\text{—}OH)](CH_3)_zSO_4^- \quad \text{(IV)}$$

wherein $R_{10}$ is a $C_{12}$-$C_{20}$ alkyl group;

z is an integer from 1 to 3.

6. The method according to claim 1, wherein the quaternary ammonium compound is selected from the group consisting of:

TET: Di(tallowcarboxyethyl)hydroxyethyl methyl ammonium methylsulfate;

TEO: Di(oleocarboxyethyl)hydroxyethyl methyl ammonium methylsulfate;

TES: Distearyl hydroxyethyl methyl ammonium methylsulfate;

TENT: Di(hydrogenated tallow-carboxyethyl)hydroxyethyl methyl ammonium methylsulfate;

TEP: Di(palmiticcarboxyethyl)hydroxyethyl methyl ammonium methylsulfate; and

DEEDMAC: Dimethylbis[2-[(1-oxooctadecyl)oxy]ethyl] ammonium chloride.

7. The method according to claim 1, wherein the composition comprises from 0.1 wt. % to 5 wt. % of the fragrance material or perfume based on the total weight of the composition.

8. The method according to claim 1, wherein the composition further comprises an inorganic salt.

9. The method according to claim 1, wherein the composition is a fabric conditioning composition.

10. The method according to claim 1, wherein the composition further comprises a silicone compound.

* * * * *